US005685518A

United States Patent [19]

Fox et al.

[11] Patent Number: 5,685,518

[45] Date of Patent: Nov. 11, 1997

[54] STAND SYSTEM FOR ERECTING AND TAKING DOWN OF A TREE

[75] Inventors: Brian Roy Fox, Woodstock; David Lachlan Hoar, Fredericton, both of Canada

[73] Assignee: Snokist Limited, Woodstock, Canada

[21] Appl. No.: 558,111

[22] Filed: Nov. 13, 1995

[51] Int. Cl.[6] ..... F16M 13/00

[52] U.S. Cl. ..... 248/523; 298/316.4; 298/519; 47/42

[58] Field of Search ..... 248/316.4, 519, 248/523; 47/40.5, 42; 74/527; 188/67, 77 W; 267/204, 205

[56] References Cited

U.S. PATENT DOCUMENTS

| | | | |
|---|---|---|---|
| 1,401,259 | 12/1921 | Ihrig . | |
| 2,630,287 | 3/1953 | Trogdon | 248/523 |
| 2,639,877 | 5/1953 | Fox | 248/523 X |
| 2,913,202 | 11/1959 | Meldrum | 248/523 X |
| 4,191,503 | 3/1980 | Neff et al. | 188/67 X |
| 4,310,989 | 1/1982 | Shannon, Jr. . | |
| 4,326,703 | 4/1982 | Marley | 248/523 X |
| 4,387,926 | 6/1983 | Van Eerden et al. | 188/67 X |
| 4,515,195 | 5/1985 | Gladstein | 248/519 X |
| 4,901,971 | 2/1990 | Connelly . | |
| 4,936,538 | 6/1990 | Royce | 47/40.5 X |
| 4,978,098 | 12/1990 | Peckinpaugh | 248/523 |
| 5,137,246 | 8/1992 | Idso | 248/526 |
| 5,375,808 | 12/1994 | Roy . | |
| 5,529,148 | 6/1996 | O'Leary | 188/67 |

*Primary Examiner*—Alvin C. Chin-Shue
*Assistant Examiner*—Richard M. Smith
*Attorney, Agent, or Firm*—Victor E. Libert

[57] ABSTRACT

A tree stand system for supporting the trunk of a previously cut a tree in an upright position, and for removal therefrom. The tree stand system has a ground-engaging base, a jaw assembly for supporting the tree trunk, a rod passing through guide supports and attached to the jaw assembly and at least two spring-biased locks on said rod. The spring-biased locks are adapted for movement of the rod and jaw assembly to retain a tree, to retain the rod in a selected position and further to permit release of the rod to effect removal of the tree trunk from the tree stand system. The tree stand system is particularly useful for display of Christmas trees outdoors.

7 Claims, 4 Drawing Sheets

STAND SYSTEM FOR ERECTING AND TAKING DOWN OF A TREE

BACKGROUND OF THE INVENTION

The present invention is directed to a stand system for erecting and taking down of a tree. It relates to trees that have previously been cut down, and which are subsequently erected for display prior to sale or for decoration. Thus, the invention particularly relates to Christmas trees. The stand system is operable by one person to erect and take down the tree, and is particularly intended for use with Christmas trees in lots or other commercial locations at which Christmas trees are offered for sale or where Christmas trees are decorated for the season. It is to be understood, however, that while reference is particularly made herein to Christmas trees, the trees could be intended for a wide variety of purposes of a religious or non-religious nature.

FIELD OF THE INVENTION

A variety of tree stands have been proposed for use in erecting and displaying Christmas trees, including Christmas trees intended for commercial sale. Some stands are particularly intended for use indoors, especially in a residence. Other stands are adaptable for use outdoors. One example of a tree stand is described in U.S. Pat. No. 5,375,808.

Stands for supporting a tree, especially a Christmas tree, require a means for supporting the tree in an upright position. Many stands are capable of being used within a residence, where the erected tree is not subjected to the vagaries of the weather. The requirements for such stands are relatively low. However, for trees intended for display in commercial or other outdoor locations, whether for sale or as part of decorations, the trees are often subjected to extreme climatic conditions, particularly wind, rain and snow. Stand systems used with such trees must be capable of maintaining the trees upright under such climatic conditions for an extended period of time. In addition, especially in locations where trees are offered for sale, it is necessary for such trees to be capable of being placed in a stand and removed therefrom in a simple and quick manner. In particular, it is important that a customer be able to obtain a tree that has been purchased in a short period of time, preferably with a minimum of labour and effort by the retailer and/or the customer.

SUMMARY OF THE INVENTION

A tree stand has now been found that is capable of being used outdoors and which is capable of having a tree erected readily and quickly therein and also removed readily and quickly.

Accordingly, one aspect of the present invention provides a tree stand system for supporting the trunk of a previously cut a tree in an upright position, and for removal therefrom, comprising:

(a) a ground-engaging base;

(b) a jaw assembly for supporting said tree trunk, said jaw assembly having a first and a second tree support cooperatively shaped to retain said tree trunk in an upright position, said first tree support being attached to said ground-engaging base and said second tree support being movable with respect to the first support;

(c) at least two guide supports attached to said ground-engaging base, in alignment with the second tree support;

(d) a rod passing through said at least two guide supports, one end of said rod being attached to said second tree support; and (e) at least two spring-biased locks on said rod, said spring-biased locks being adapted for movement of the rod and said second tree support attached thereto towards said first tree support and to retain said rod in a selected position and further to permit release of said rod from said selected position to effect removal of the tree trunk from the tree stand system.

The present invention will be illustrated with reference to the embodiments shown in the drawings in which.

Figure 1:
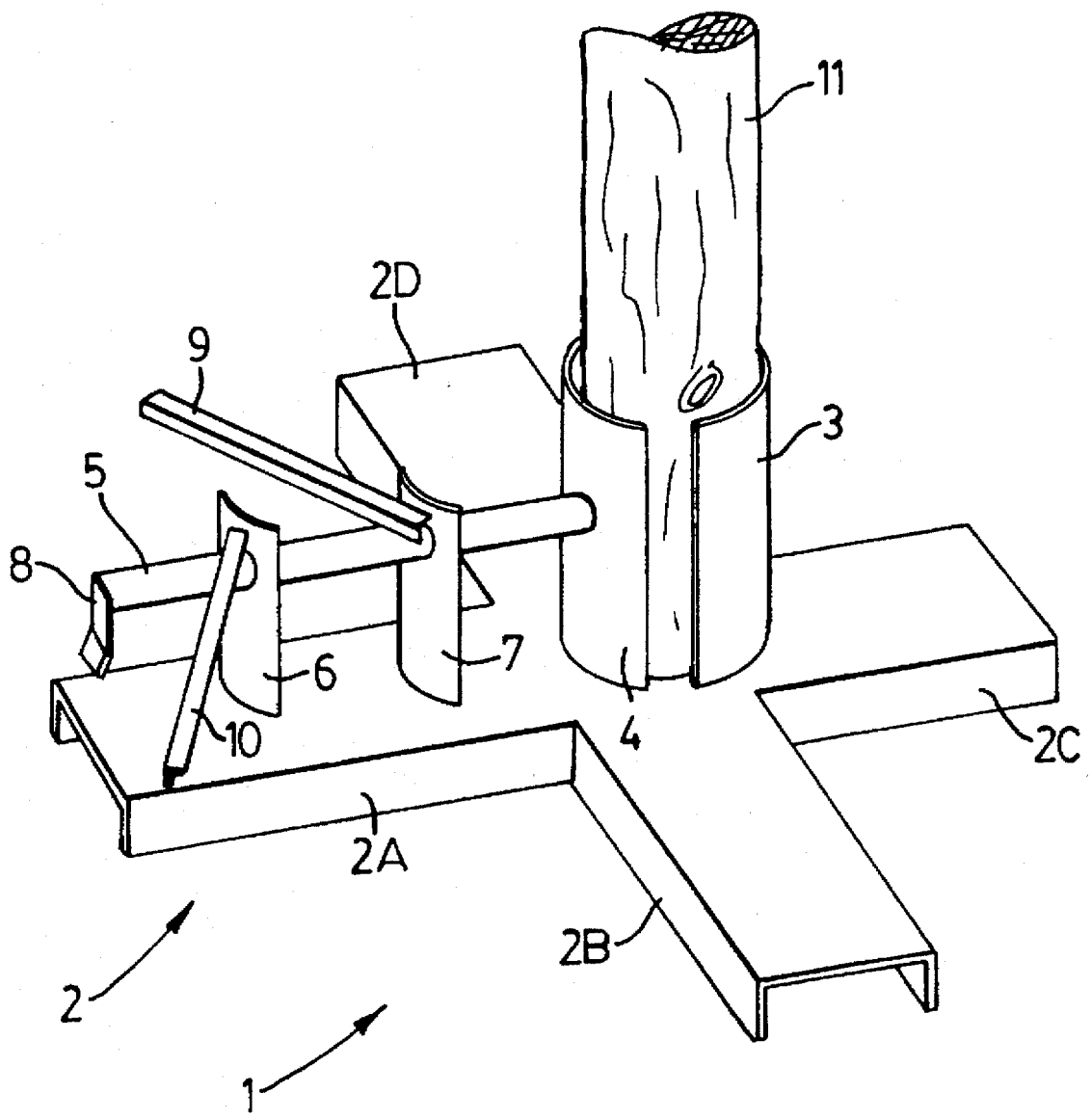
FIG. 1 is a schematic representation of a perspective view of a stand system with a tree.

FIG. 1 shows a tree stand system 1 of the invention having a ground-engaging base 2 with four legs 2A, 2B, 2C, and 2D extending in a cross pattern. Ground-engaging base 2 has a first tree support 3 fixedly attached to ground-engaging base 2. In addition, second tree support 4 is located so as to form a jaw assembly with first tree support 3, the supports of the jaw assembly acting cooperatively to hold trunk 11 of the tree in an upright position.

Second tree support 4 is a movable support, and is attached to rod 5. While rod 5 is generally referred to herein as a rod, it is understood that rod 5 may actually be a pipe i.e. have a hollow interior, to reduce weight of the tree stand system, or other cylindrical member of suitable dimensions. Rod 5 extends from second tree support 4 through second guide support 7 and first guide support 6, extending away from first guide support 6 to end at flange 8.

Installation lever 9 is shown located at second guide support 7 and extending away therefrom. Release lever 10 is shown adjacent to first guide support 6 and extending away therefrom. Further details of first and second guide supports 6 and 7, installation lever 9 and release lever 10, and the operation thereof, are shown in the remaining drawings.

Figure 2:
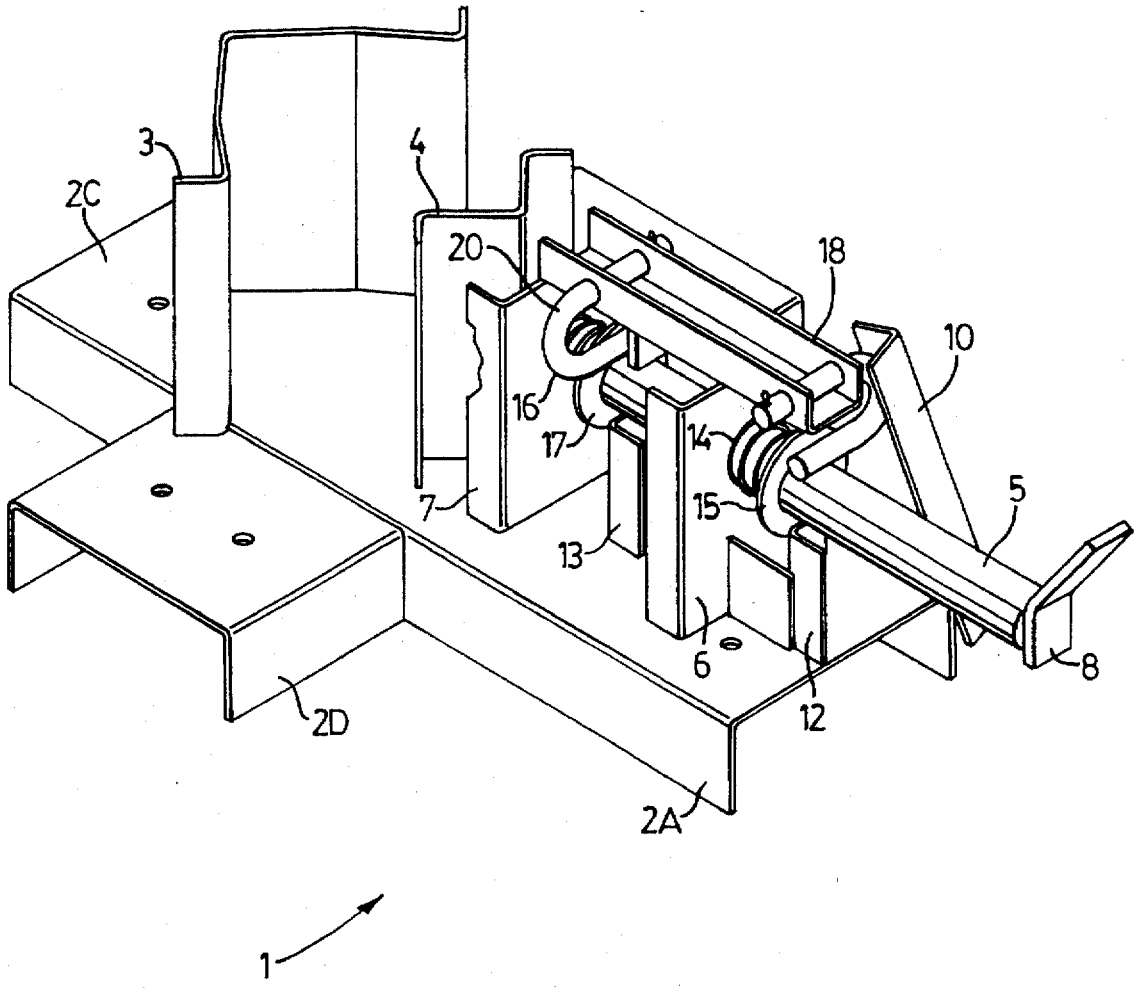
FIG. 2 is further schematic representation of a view of the stand system, showing detail of the stand system.

FIG. 2 shows part of stand system 1 in greater detail than that shown in FIG. 1, but with installation lever 9 removed for clarity. In the embodiment shown, first tree support 3 and second tree support 4 are shown as being reversed w-shaped flanges, with the centre section accentuated, in an opposed relationship. First tree support 3 and second tree support 4 are adapted to cooperatively support the trunk of a tree placed therebetween. First tree support 3 is fixedly attached to ground-engaging base 2. Second tree support 4 is free to move across the surface of ground-engaging base 2 such that the distance between first tree support 3 and second tree support 4 may be varied to accommodate tree trunks of varying sizes.

Second tree support 4 is connected to rod 5, which is utilized in both positioning of second tree support 4 and retention of second tree support 4 in a selected position. Rod 5 passes from second tree support 4 through second guide support 7 and first guide support 6. One end of rod 5 is attached to second tree support 4, while the other end of rod 5 is attached to angled flange 8. Rod 5 passes over first rod flange 12 and second rod flange 13.

Between first guide support 6 and first rod flange 12 are located first spring 14 and first washer 15, with first spring 14 being located between and abutting first guide support 6 and first washer 15, and on the side of first guide support 6 that is opposite the location of second tree support 4. Similarly, second spring 16 is located between second guide support 7 and second washer 17, with second washer 17 being located between second guide support 7 and second rod flange 13. The positioning of the springs and washers is more clearly seen in FIG. 3.

A U-bar 18 is located above both springs and washers, extending from second guide support 7 to beyond first washer 15. U-bar 18 is shown as being parallel to and located above rod 5, although it is understood that other means could be used in place of U-bar 18. First C-rod 19 passes through U-bar 18 and extends down and around to be above rod 5 at a location opposite first washer 15. Release lever 10 has one end thereof attached to first C-rod 19, with the other end of release lever 10 being free to move, to effect rotation of C-rod 19. Similarly second C-rod 20 passes through U-bar 18 at a location near second guide support 7 and extends down and around to be above rod 5 at a location oppostie second washer 17. One end of installation lever 9 is attached to second C-rod 20, to effect rotation of C-rod 20, but is not shown in FIG. 2.

Figure 3:
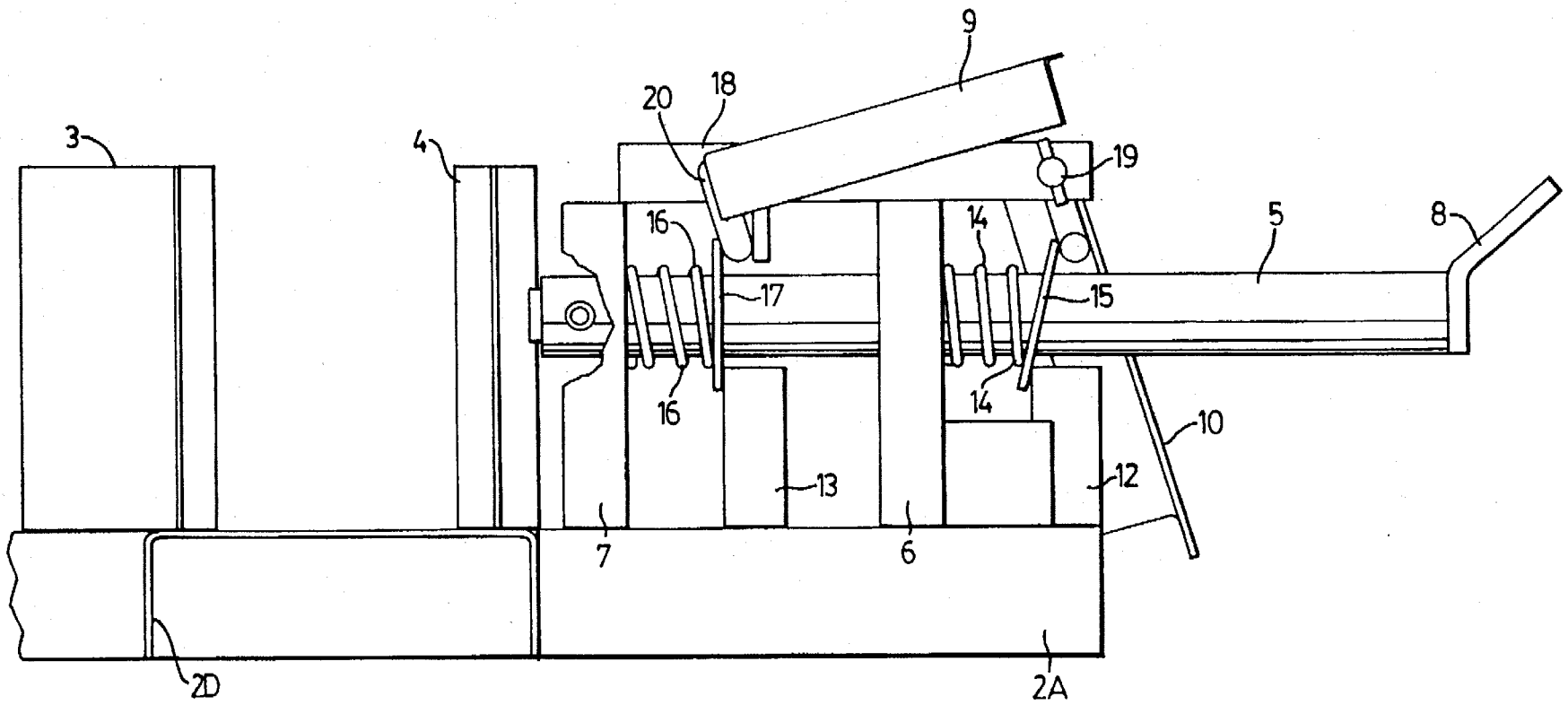
FIG. 3 is a schematic representation of a section of a side view of the stand system.

FIG. 3 shows a side view of tree stand system 1. First tree support 3 is shown opposed second tree support 4, which is attached to rod 5. Rod 5 extends through second guide support 7, first guide support 6 and extends therefrom to end at flange 8. Spring 16 is shown located between second guide support 7 and washer 17. Washer 17 is shown as abutting second rod flange 13 and second C-rod 20. Similarly, first spring 14 is shown between first guide support 6 and washer 15. Washer 15 is shown as being in contact with first rod flange 12 and first C-rod 19. It will be noted that washer 15 is at an angle to the axis of rod 5, as first rod flange 12 is offset from first C-rod 19, but may be moved to a substantially vertical position using release lever 10, as discussed herein. Installation lever 9 is shown attached to second C-rod 20. Release lever 10 is shown as attached to first C-rod 19.

Figure 4:
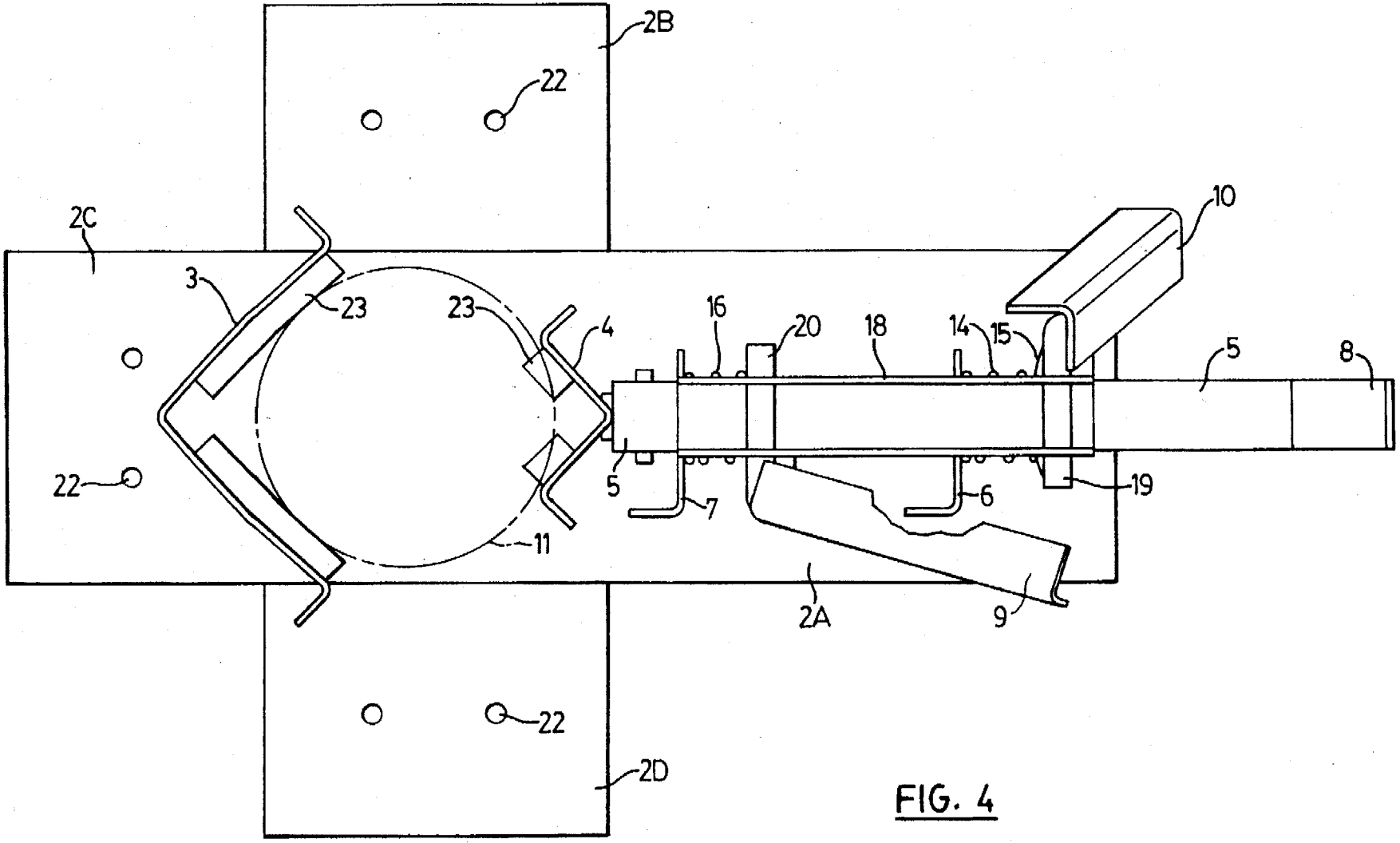
FIG. 4 is a schematic representation of a section of the stand system viewed from above.

FIG. 4 shows a plan view of tree stand system 1. First tree support 3 is shown as opposed to second tree support 4. In the embodiment shown first tree support is substantially larger in size than second tree support 4; the tree supports may be of the same or different sizes, with the embodiment shown being preferred. Optionally, pads 23 may be placed or attached to one or both of the tree supports so as to be between the tree supports and the tree trunk. Rod 5 is attached to second tree support 4 and extends through second guide support 7, first guide support 6 and terminates at flange 8. Spring 16 is shown as located between guide support 7 and washer 17. The latter is located directly beneath C-rod 20 and not apparent in this Figure. Similarly, spring 14 is shown between first guide support 6 and washer 15, which is apparent in FIG. 4 because of its angled nature with respect to rod 5. Washer 15 is partially below first C-rod 19.

In operation, rod 5 is pulled through first guide support 6 and second guide support 7 such that second tree support 4 is moved away from first tree support 3 for a distance sufficient to accommodate the size of the trunk of the tree that is to be placed in tree stand system 1. To do so, it would be necessary to press the free end of release lever 10. When the free end is pressed, C-rod 19 is rotated, thereby forcing washer 15 into a substantially vertical position, which permits movement of rod 5.

The tree is placed with its trunk between first tree support 3 and second tree support 4 such that the base of the trunk rests on ground-engaging base 2. The operator then pushes rod 5, normally by pushing flange 8 with his or her foot such that second tree support 4 comes in contact with trunk 11. The operator then pushes, again usually with his or her foot, installation lever 9 and pumps the lever one or more times, at which time rod 5 is urged towards trunk 11, thereby tightening the grip of tree support 3 and tree support 4 on trunk 11. Pushing on the free end of installation lever 9 causes C-rod 20 to rotate. This, in turn, urges washer 17 towards trunk 11, but in doing so washer 17 locks onto or engages rod 5, thereby urging rod 5 towards trunk 11, for the purpose of holding trunk 11 in position between first and second tree supports 3 and 4. When pressure on installation lever 9 is released, spring 16 moves washer 17 back towards its original position. However, rod 5 does not move, as washer 15 engages with rod 5 and acts as a brake to prevent retraction of rod 5. The procedure of pressing on installation lever 9 may then be repeated. The urging of rod 5 toward tree trunk 11 should be done sufficiently often to maintain trunk 11 in position without overtightening of second tree support 4 around trunk 11.

To release tree trunk 11 from tree stand system 1, the operator pushes on release lever 10 again normally using his or her foot. This disengages washer 15 and allows rod 5 to be moved away from trunk 11.

Washers 15 and 17 are preferably hardened washers, to increase the practical life of the washers. Rod 5 would normally be a galvanized rod. It is preferred that rod 5 not be a painted rod.

The stand system of the present invention is capable of supporting a variety of trees. For instance, with first tree support 3 and second tree support 4 having vertical dimensions in the range of about 4 inches to 12 inches, it is possible to accommodate trees of a variety of heights, typically including trees having a height of about 5–12 feet and tree trunks with diameters of about 2.5 to 6 inches. Such sizes of trees are typical trees used for Christmas trees and could be lifted and moved by a single person.

The arms of ground-engaging base 2 should be of dimensions suitable to accommodate a board e.g. a board measuring 2 inches by 6 inches. Such boards may be placed within the arms of ground-engaging base 2 and attached thereto using screws or nails through orifices 22 located in the arms of ground-engaging base 2. This provides additional stability against wind effects for a single tree, but also enables a plurality of tree stand systems to be interconnected for both orderly arrangement and greater stability of the entire group of trees.

The present invention is illustrated by the following example.

EXAMPLE I

A tree stand system was made substantially as shown in the drawings. The system weighed 21 lbs. and was intended to support trees up to 12 feet in height and tree trunks up to about 6 inches in diameter. The tree supports had a height of approximately 6 inches above ground-engaging base 22, with the movable tree suport (second tree support 4) being spaced from ground-engaging base 2 by approximately 0.25 inches. Rod 5 had a diameter of approximately 1.3 inches.

The tree stand system could be operated easily by one person to erect and remove trees.

What is claimed is:

1. A tree stand system for supporting a trunk of a previously cut tree in an upright position, and for removal therefrom, comprising:

(a) a ground-engaging base;

(b) a jaw assembly for supporting said tree trunk, said jaw assembly having a first and a second tree support cooperatively shaped to retain said tree trunk in an upright position, said first tree support being attached to said ground-engaging base and said second tree support being movable with respect to the first support;

(c) at least two guide supports attached to said ground-engaging base, in alignment with the second tree support;

(d) a rod passing through said at least two guide supports, one end of said rod being attached to said second tree support, said rod passing through at least two spring-biased locks; and (e) said spring-biased locks being adapted for (1) imposing a biasing force on the rod for movement of the rod and said second tree support attached thereto towards said first tree support and to retain said rod in a selected position, and (2) releasing the biasing force to permit release of said rod from said selected position to effect removal of the tree trunk from the tree stand system.

2. The tree stand system of claim 1 in which one of said spring-biased locks is adapted to retain and release the rod and the other of said spring-biased locks is adapted to permit movement of the rod.

3. The tree stand system of claim 1 in which said spring-biased locks are maintained in compression to carry out the imposing of the biasing force on the rod.

4. A tree stand system for supporting a trunk of a previously cut tree in an upright position, and for removal therefrom, comprising:

(a) a ground-engaging base;

(b) a jaw assembly for supporting said tree trunk, said jaw assembly having a first and a second tree support cooperatively shaped to retain said tree trunk in an upright position, said first tree support being attached to said ground-engaging base and said second tree support being movable with respect to the first support;

(c) at least two guide supports attached to said ground-engaging base, in alignment with the second tree support;

(d) a rod passing through said at least two guide supports, one end of said rod being attached to said second tree support, said rod passing through at least two spring-biased locks; and (e) each of said spring-biased locks comprising a spring and a washer on said rod, with the spring being located between and abutting said washer and one of said guide supports, said spring-biased locks being adapted for movement of the rod and said second tree support attached thereto towards said first tree support and to retain said rod in a selected position and further to permit release of said rod from said selected position to effect removal of the tree trunk from the tree stand system.

5. The tree stand system of claim 4 in which said movement of the rod and said second tree support towards said first tree support is effected using a lever that causes movement of one of said washers, the other of said washers permitting said movement of the rod and second tree support but preventing movement of said rod and second tree support in the opposite direction.

6. The tree stand system of claim 5 in which the release of said rod is effected using a lever that moves the other of said washers.

7. The tree stand system of claim 4 in which one of said spring-biased locks is adapted to retain and release the rod and the other of said spring-biased locks is adapted to permit movement of the rod.

* * * * *

UNITED STATES PATENT AND TRADEMARK OFFICE

CERTIFICATE OF CORRECTION

PATENT NO. : 5,685,518

DATED : November 11, 1997

INVENTOR(S) : Fox et al.

It is certified that error appears in the above-indentified patent and that said Letters Patent is hereby corrected as shown below:

In the Abstract, line 2, change "cut a tree" to read --cut tree--.

In column 1, line 51, change "cut a tree" to read --cut tree--.

After column 2, line 10, insert --BRIEF DESCRIPTION OF THE DRAWINGS--.

After column 2, line 20, insert --DETAILED DESCRIPTION OF THE INVENTION AND PREFERRED EMBODIMENTS THEREOF--.

In column 2, line 31, insert a comma after "pipe".

In column 2, line 32, insert a comma after "i.e.".

In column 3, line 19, change "oppostie" to read --opposite--.

In column 3, line 40, insert a comma after "shown".

UNITED STATES PATENT AND TRADEMARK OFFICE

CERTIFICATE OF CORRECTION

PATENT NO. : 5,685,518

DATED : November 11, 1997

INVENTOR(S) : Fox et al.

It is certified that error appears in the above-indentified patent and that said Letters Patent is hereby corrected as shown below:

In column 3, line 40, change "tree support" to read --tree support 3--.

In column 4, line 38, change "e.g." to read --, e.g.,--.

In column 4, line 54, change "22" to read --2--.

In column 4, line 55, change "suport" to read --support--.

Signed and Sealed this

Seventeenth Day of March, 1998

*Attest:*

*Attesting Officer*

BRUCE LEHMAN

*Commissioner of Patents and Trademarks*